United States Patent [19]

Möllendorf et al.

[11] 4,061,920

[45] Dec. 6, 1977

[54] X-RAY INSTALLATION COMPRISING AN IMAGE INTENSIFIER/IMAGE PICK-UP TUBE SYSTEM AND AN AUTOMATIC X-RAY EXPOSURE DEVICE

[75] Inventors: Ralf Möllendorf, Ahrensburg; Peter Lux, Hamburg, both of Germany

[73] Assignee: U.S. Philips Corporation, New York, N.Y.

[21] Appl. No.: 666,652

[22] Filed: Mar. 15, 1976

[30] Foreign Application Priority Data

Mar. 15, 1975 Germany ..... 2511523

[51] Int. Cl.[2] ..... H05G 1/30

[52] U.S. Cl. ..... 250/413; 250/416 R

[58] Field of Search ..... 250/402, 413, 416 R, 250/416 TV, 322, 354, 389

[56] References Cited

U.S. PATENT DOCUMENTS

| | | | |
|---|---|---|---|
| 2,796,527 | 6/1957 | Oosterkamp et al. | 250/413 |
| 3,573,461 | 4/1971 | Ohlsson | 250/402 |
| 3,602,641 | 8/1971 | Heise | 250/416 TV |
| 3,821,552 | 6/1974 | Hermeyer | 250/416 R |
| 3,894,235 | 7/1975 | Franke | 250/416 R |
| 3,974,385 | 8/1976 | Grim | 250/413 |

*Primary Examiner*—Bruce C. Anderson

*Attorney, Agent, or Firm*—Frank R. Trifari

[57] ABSTRACT

The invention relates to an X-ray installation which comprises a television display device and an automatic exposure device and in which dominant selection is no longer required. The television image produced during fluoroscopy is sub-divided into a large number of sub-fields, a storage position being assigned to each sub-field. In each storage position the part of the video signal is stored which corresponds to the assigned sub-field. The sub-fields are then determined which contain the regions of the maximum and the minimum brightness. An effective, organ-programmed intermediate value is derived therefrom. Moreover, the mean value of the video signal is obtained in the part of the television image assigned to the sole central measuring field of the automatic exposure device. The mean value is compared with the intermediate value, and the switch-off dose or switch-off voltage is corrected in dependence of the difference thus found.

5 Claims, 2 Drawing Figures

Figure 1:
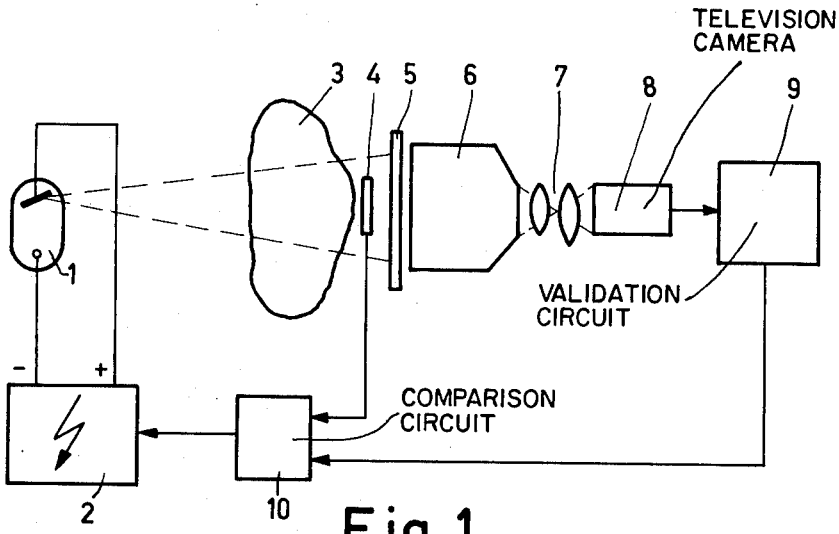

X-RAY INSTALLATION COMPRISING AN IMAGE INTENSIFIER/IMAGE PICK-UP TUBE SYSTEM AND AN AUTOMATIC X-RAY EXPOSURE DEVICE

The invention relates to an X-ray installation comprising an image intensifier/image pick-up tube system and an automatic exposure device comprising means for recording a given mean dose determined from a number of subfields by means of video signals recorded during fluoroscopy prior to the exposure.

The measuring member of an automatic X-ray exposure device of the commonly used type consists of an ionization chamber which usually comprises several measuring fields. The measuring field (the dominant) which offers optimum exposure must each time be selected by the radiologist. It is important that this measuring field is always situated in the part of the X-ray image of the patient which is important for diagnosis.

The selection of a measuring field which is suitable for automatic exposure impedes the actual medical function of the radiologist. Moreover, incorrect exposures can occur due to incorrect selection of the dominant or due to the covering of part of the measuring field, for example, by a contrast medium filling.

In order to avoid these drawbacks, an automatic X-ray exposure device has been proposed (German patent application No. P 24 11 630) comprising a measuring member, for example, an ionization chamber, having a substantial number of measuring fields (for example, 5 × 5). Each measuring field has associated with it a capacitor which is charged by the part of the video signal corresponding to the measuring field during the fluoroscopy. The extent of the charging of the capacitors is proportional to the amount of radiation occurring in the measuring field associated with the capacitor. The dose measured in each of the measuring fields is subsequently used for the automatic exposure in as far as the recorded doses are situated within a given range between a predetermined maximum value and minimum value.

A drawback of this device is the large number of measuring fields which may give rise to structural problems.

Therefore, the invention has for its object to realize a simple X-ray installation of the kind set forth which eliminates the operation by the radiologist as well as the large number of measuring fields. To this end, an X-ray installation in accordance with the invention is characterized in that the automatic exposure device comprises a measuring member for a central measuring field and a superimposition circuit for determining the difference between a mean value measured in sub-fields of the central measuring field and a value derived from the mean values measured in sub-fields across the total fluoroscopic image, and for the superimposition of the difference thus formed on a signal which is constant in all operating conditions.

In practice it may occur, particularly in the case of low voltages on the X-ray tube, that the density range of the radiation behind the object, i.e. the difference between the highest and the lowest radiation density behind the object, cannot be handled by the film, so that in given circumstances details which are important for the diagnosis do not appear in the image. Therefore, the switch-off dose must be chosen so that structures having an absorption behaviour corresponding to the details important for the diagnosis are optimally exposed. The correct exposure is thus substantially dependent of the organ to be displayed, for example, an X-ray exposure of a soft part (for example, a lung exposure) requires a switch-off dose other than an X-ray exposure of bones (for example, a spinal cord exposure). A further preferred embodiment of the installation in accordance with the invention which can be used in apparatus incorporating the "programmed exposure technique" comprises an X-ray generator which includes a presetting unit for presetting the exposure data for different organs, the exposure data for an organ being adjustable by operation of a push button assigned to the organ, the presetting unit comprising means for presetting a weighting factor, assigned to the relevant organ, for the value derived from the total fluoroscopic image and/or for the mean value in the central measuring field. This embodiment also enables properly exposed exposures if the range of the modulation caused by the object is larger than the range of the film.

The value derived from the total fluoroscopic image can be simply formed by determining the mean value of the total video signal. The different absorption capacity of different organs can be taken into account in that this mean value is weighted by different weighting factors, which may be smaller or larger than 1, before the difference with respect to the mean value assigned to the central measuring field is formed in the substraction circuit. When the mean value of the video signal across the total fluoroscopic image is used as the value for the total fluoroscopic image, the following result can be obtained.

In the case of an exposure of an organ whose absorption capacity deviates substantially from that of its surroundings, the resultant mean value is substantially dependent of the degree of stopping of the X-radiation. Consequently, the switch-off dose calculated according to the invention is also substantially dependent upon stopping; this is undesirable. A further preferred embodiment of the installation in accordance with the invention is characterized in that outputs of storage devices for storing the maximum and the minimum mean values of all sub-fields are connected to means for adjusting a value between the maximum and the minimum value. An exposure control system thus constructed ensures that the switch-off dose found is substantially independent of the degree of stopping, because the extreme values found remain to a large extent unaffected.

The invention will be described hereinafter with reference to a preferred embodiment of the installation which is shown in the drawing.

Figure 2:
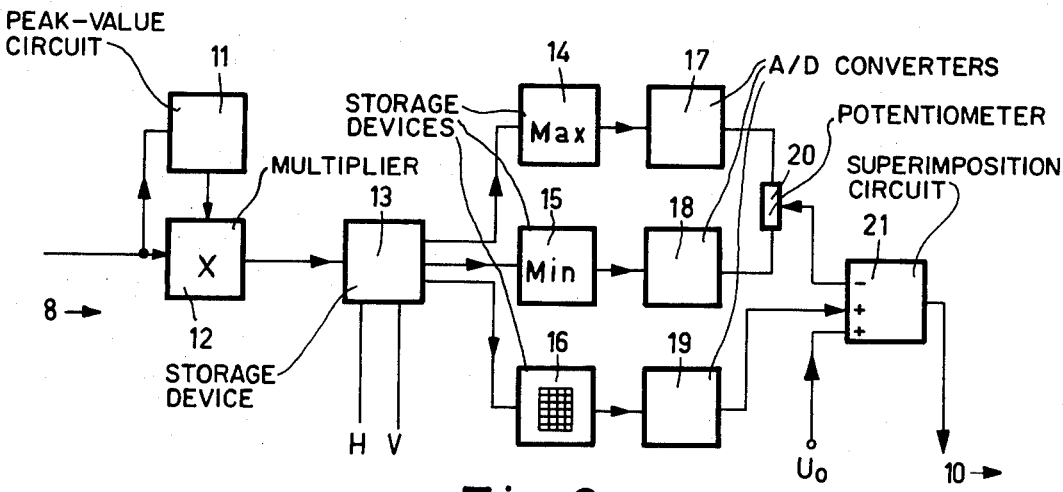

FIG. 1 diagrammatically shows an X-ray installation in accordance with the invention, and FIG. 2 shows a block diagram of the validation circuit in accordance with the invention.

FIG. 1 shows an X-ray tube 1 which is connected to a high-voltage generator 2. The radiation emitted by the tube 1 irradiates a patient 3 and reaches the central measuring field 4 of a measuring member which is adapted to receive radiation, for example, an ionization chamber. A film in a cassette 5 properly shows an X-ray shadow image formed by the object behind the object in the case of optimum exposure. The X-ray generator, only the tube 1 and the high-voltage generator 2 thereof being shown in the drawing, is adapted for the programmed exposure technique. Therefore, the generator comprises an exposure data presetting unit which is preset by operation of pushbuttons associated with each relevant organ (not shown).

During fluoroscopy, the cassette is situated outside the beam path. The X-ray shadow image then appears on the luminescent input screen of an image intensifier 6, a television camera 8 being coupled to the luminescent output screen thereof via an objective 7. The video signal supplied by the television camera 8 is applied to a validation circuit 9. This circuit determines, on the basis of the video signal during fluoroscopy, the dose at which the high-voltage generator is to be switched off to ensure correct exposure of a subsequent X-ray exposure. A signal $W_a$, supplied by the validation circuit 9 for this purpose, is applied to a comparison circuit 10 which compares this signal, generated during fluoroscopy, with a signal $U_i$ which is generated during the exposure and which is proportional to the dose. If the signal supplied by the measuring member 4 is proportional to the dose power, an integrator should be inserted between the measuring member 4 and the comparison circuit 10. When the signal supplied by the measuring member, which increases substantially with time under constant exposure conditions, reaches the value of the signal supplied by the validation circuit 9, the comparison circuit 10 causes the switching off of the high voltage from the high-voltage generator 2, thus terminating the exposure.

The center of the measuring member 4 is arranged in the center of the stopped X-ray beam and has a measuring field (perpendicularly to the direction of the X-rays) which is smaller than the smallest exposure format used. However, it is alternatively possible for the effective measuring field of the measuring member 4 to be switchable in dependence upon the exposure format, so that in the case of a small exposure format the measuring field is reduced to include only the measuring field of the radiation. However, because a reduction of the effective measuring field of the measuring member 4 is accompanied by a corresponding reduction of the signal $U_i$, an amplifier must then be provided which increases the gain accordingly again, so that ultimately the voltage $U_i$ on the output of the comparison circuit 10 is independent of the exposure format or the magnitude of the stopped X-ray beam.

The block diagram of the validation circuit 9 is shown in FIG. 2. The television image is sub-divided into a number of equally large sub-fields, for example, 10 × 10. The video signal part associated with a sub-field is linewise stored by means of a sample-and-hold circuit, is digitized and is subsequently added to a corresponding storage matrix which comprises a storage position for each sub-field. After the television signal of a frame has thus been assigned to the various storage positions, each storage position contains a signal having a value which corresponds to the mean value of the video signal in the sub-field of the television image assigned to that storage position. The largest and the smallest mean value can be obtained by comparison of the values assigned to the storage positions. From these two extreme values a value is derived which is nearer to the higher or the lower extreme value, depending on the organ of which a shadow image is to be formed. This derived value is compared with the mean value of the video signal obtained by way of from the mean values of the sub-fields assigned to the central measuring field (i.e. situated behind the central measuring field). If the mean value and the derived value are equal, the switch-off dose is not corrected; however, if these values are not the same, the (basic) switch-off dose is changed in dependence of the sign and the magnitude of the difference between the two values.

Even though it is simplest, from a switching point of view, to assign the video signal to separate storage positions, it is not absolutely necessary for the sub-fields in which the television image is sub-divided to be rectangular with sides adapted to the television frame. For example, in the case of a circular fluoroscopic image, segments of this circle can be selected as the sub-fields. The sub-fields need not be equally large either. However, if sub-fields of different dimensions are chosen, the value of the corresponding switch-off dose must be adapted thereto.

The validation circuit which is shown in detail in FIG. 2 determines the switch-off dose on the basis of a video signal $s(t)$ in slightly more than two frame periods. The operation of this circuit is largely digital, but analog operation is in principle also possible.

The video signal $s(t)$ is inter alia applied to an input of a peak-value circuit 11 which determines and stores the peak value of the video signal during a first frame. The video signal can, moreover, be applied to one of two sample-and-hold circuits (not separately shown) which are connected to the television camera and which are timed such that one circuit integrates the video signal across a portion of the line length and stores it, while at the same time the other circuit is connected to the input of a multiplying analog-to-digital converter 12. The peak value $s_p$ of the video signal is present on a further input of the converter 12. Each time when the part of a line of the television image assigned to a sub-field terminates, a switch-over takes place. Thus, in the case of 10 × 10 fields, each time after 1/10th of the line length the sample-and-hold circuit which was previously connected to the input of the multiplying analog-to-digital converter 12 then integrates the video signal across part of the line length or otherwise determines the mean value of the video signal across the next part of the line, and then vice versa.

The multiplying analog-to-digital converter 12 supplies a digital output signal which is proportional to the quotient $\overline{s(t)}/s_p$, $\overline{s(t)}$ being the value of the video signal averaged across the relevant part of the line. The quotient $\overline{s(t)}/s_p$ changes in proportion to a change of the fluorescopy current, so that the mean switch-off dose is independent of the fluoroscopy current; this is generally desirable. If the video signal were to be influenced by an automatic gain control system so that the value $\overline{s(t)}$ were independent of the fluoroscopy current, the normalization, i.e. the multiplication by the factor $1/s_p$ could be dispensed with.

The output signal of the multiplying analog-to-digital converter 12 is applied to a storage device 13 which comprises a number of storage positions which corresponds to the number of sub-fields. The assignment of the output signal of the multiplying analog-to-digital converter 12 to the individual storage positions is effected, under the control of the horizontal and vertical synchronization pulses H and V, respectively, of the television image, so that the mean part of the video signal is stored, in each storage position the said part corresponding to the sub-field to which the storage position has been assigned. For the first line of the second frame, therefore, the first ten storage positions are assigned the value of the video signal each time averaged 1/10th of the first line length. For the second line of the second frame, the digital signal $\overline{s(t)}/s_p$ — each time averaged across 1/10th of the second line — is added to the contents of the first 10 storage positions, etc. After 1/10th of the number of lines of the second frame has thus been stored in the first 10 storage positions, i.e. about 32 lines in the case of a 625-line image, the second 10 storage positions are filled accordingly etc. At the end of the second frame, each storage position contains a value which corresponds to the mean value of the video signal across the sub-field assigned to the relevant storage position (divided by $s_p$).

An analog storage device as proposed in the previous German patent application No. P 24 11 630 can in principle also be used. However, in that case a large number — 100 in the present example — of analog storage elements are required; these are generally capacitors having a low leakage current. For a large number of storage positions, the digital storage is less expensive and, moreover, more accurate.

Following the second frame, inter alia the largest and the smallest mean value assigned to a sub-field are obtained, and the mean value is determined of the video signal in the part of the television image assigned to the measuring field and, therefore, enclosing the same beam as the measuring field. The maximum value then obtained is usually smaller than the peak value of the video signal (normalized to the peak value), because the absolute peak value is involved, but rather the video signal averaged across the sub-field corresponding to the most intense radiation. The measurement of the extreme values can be effected in the manner disclosed in the said German patent application No. P 24 11 630.

In the embodiment in accordance with the invention, for example, the maximum value is determined in that the contents of the storage positions of the storage device 13 are consecutively compared with the contents of a storage position in a storage device 14 for obtaining the maximum value. Initially, the value 0 is stored in the storage device 14. If the value each time stored in the storage device 13 exceeds the value stored in the storage device 14, the value of the storage device 13 is non-destructively transferred to the storage position in the storage device 14. Subsequently, this value is compared with the contents of the next storage position of the storage device 13, etc. The effect of overexposed sub-fields can be eliminated in that sub-fields whose mean value is not smaller, by a given fraction, for example 10%, than a digital value assigned to the peak value are not accepted by the storage device 14. Furthermore, it may be efficient to use not only a single sub-field having the highest mean value, but rather the three sub-fields having the highest mean values and to determine the maximum value therefrom by forming the mean value. In that case the storage device 14 should comprise three storage positions; if the value stored in the relevant storage position of the storage device 13 is smaller than the value stored in the first maximum value storage position, which each time stores the highest value, but larger than the value stored in the second maximum value storage position, this value is transferred to the second maximum value storage position whose contents are then shifted to the third maximum value storage position, so that the previous contents of the latter position are erased, etc.

Similarly, the smallest mean value can be obtained at the same time. The effect of non-exposed fields, for example, because they were covered during the X-ray exposure, can then be reduced by taking into account only measuring fields whose mean value exceeds the value 0 by a given amount.

The overexposed and non-exposed sub-fields can alternatively be eliminated in the manner described in the previous German patent application No. P 24 11 630. The formation of the mean value across the part of the video signal assigned to the measuring field is effected in that the contents of the storage positions for the sub-fields associated with this measuring field are summed in a summing device and are subsequently divided by the number of sub-fields assigned to the measuring field. This is diagrammatically represented in FIG. 2 by means of a block 16; the output of this block thus carries a digital signal whose value is proportional to the mean value of the video signal at the area of the measuring field.

The three circuits 14, 15 and 16 are each connected to a digital-to-analog converter 17, 18 and 19, respectively. The outputs of the digital-to-analog converters 17 and 18 which are connected to the devices 14 and 15 for obtaining the highest and the lowest mean value, respectively, are interconnected via a potentiometer 20. The position of the wiper of the potentiometer 20 each time determines whether the less-transmissive or more-transmissive areas of the object are optimally exposed. For example, if a low-transmissive part is to be optimally exposed, for example, a leg, the wiper must be slid towards the upper end of the potentiometer 20. If parts of the body which transmit more radiation are to be exposed, for example, soft parts, the wiper should be slid in the direction of the lower end of the potentiometer. For each organ to be exposed according to the programmed exposure technique, a potentiometer 20 is included in an associated presetting unit (not shown in the drawing). This potentiometer is connected between the outputs of the digital-to-analog converters 17 and 18 when the pushbutton assigned to this organ is actuated, its wiper then being connected to the inverting input of a superimposition circuit 21. A further, non-inverting, input of the superimposition circuit 21 receives a signal from the output of the digital-to-analog converter 19 which is proportional to the mean value of the video signal at the area of the measuring field. The difference is superimposed on a constant voltage $U_O$ which is applied to a third input of the superimposition circuit 21 and which is the same in all operating conditions. The output voltage $U_u$ of the superimposition circuit 21, applied to the one input of the comparison circuit 10 (see FIG. 1), thus corresponds to the sum of the voltage $U_O$ and the voltage difference between the output of the digital-to-analog converter 19 and the wiper of the potentiometer 20.

The determination of the switch-off dose which is decisive for terminating the exposure and which is represented by the voltage $U_u$ supplied by the validation circuit 9, can be effected by operating the exposure starter in the case of an exposure following fluoroscopy, because only comparatively little time is then required. However, the fluoroscopy conditions may not be changed during the operation of the exposure starter but only after expiration of the time required for generating the voltage $U_u$. It is alternatively possible to generate this signal periodically during fluoroscopy.

The control circuit, determining the operating sequence of the individual circuit components, is not shown in FIG. 2 for the sake of simplicity (only the lines for the horizontal synchronization pulses H and the vertical synchronization pulses V are shown). Its function, however, will be readily understood by those skilled in the art on the basis of the foregoing description.

What is claimed is:

1. X-ray apparatus, comprising:

means for producing a fluoroscopy image of an object, the image being subdivided into a multiplicity of sub-fields;

means for deriving maximum and minimum image intensities from the image intensities of the sub-fields;

means for deriving from the maximum and minimum image intensities an intermediate image intensity dependent upon the type of X-ray exposure subsequently desired of the object;

means for deriving a mean image intensity in sub-fields constituting a central measuring field;

means for deriving a switch-off dose by comparing the mean image intensity with the intermediate image intensity and adding the difference to a fixed value independent of the type of X-ray exposure subsequently desired;

means for measuring an X-ray dose in the central measuring field; and means for comparing the measured X-ray dose during a subsequent exposure of the object with the derived switch-off dose and for terminating the exposure when they are equal.

2. X-ray apparatus as defined in claim 1 wherein said means for deriving maximum and minimum image intensities comprises means for disregarding overexposed and underexposed sub-fields by considering only sub-fields having intensities which deviate from the absolute maximum and absolute minimum sub-field intensity by a predetermined fractional amount.

3. X-ray apparatus as defined in claim 1 wherein said means for deriving maximum and minimum image intensities comprises means for deriving maximum and minimum mean intensities from groups of maximum and minimum intensity sub-fields.

4. X-ray apparatus as defined in claim 1 and further comprising means for normalizing the image intensities of the sub-fields.

5. X-ray apparatus as defined in claim 4 wherein said means for normalizing comprises means for measuring the peak value of the image intensity and for dividing each of the image intensities of the sub-fields by the measured peak value.

* * * * *